US012383042B1

(12) United States Patent
Strickland

(10) Patent No.: US 12,383,042 B1
(45) Date of Patent: Aug. 12, 2025

(54) FINGERNAIL CLIPPER

(71) Applicant: Ashley Strickland, Pleasant Grove, AL (US)

(72) Inventor: Ashley Strickland, Pleasant Grove, AL (US)

( * ) Notice: Subject to any disclaimer, the term of this patent is extended or adjusted under 35 U.S.C. 154(b) by 254 days.

(21) Appl. No.: 18/198,604

(22) Filed: May 17, 2023

(51) Int. Cl.
*A45D 29/02* (2006.01)
*A45D 29/06* (2006.01)

(52) U.S. Cl.
CPC ..... *A45D 29/02* (2013.01); *A45D 29/06* (2013.01)

(58) Field of Classification Search
None
See application file for complete search history.

(56) References Cited

U.S. PATENT DOCUMENTS 2,620,560 A 12/1952 Bahr
3,812,868 A 5/1974 Keating
4,637,137 A 1/1987 Husain
4,819,673 A 4/1989 McMullen, Jr.
4,856,190 A * 8/1989 Reiswig ..... A45D 31/00 30/29
4,982,747 A 1/1991 Shah
5,357,677 A * 10/1994 West ..... A45D 29/02 30/177
5,727,318 A 3/1998 Reiswig
5,918,375 A * 7/1999 Rossi, III ..... A45D 29/02 132/75.5
7,003,882 B2 2/2006 Sakai
8,683,700 B1 4/2014 Keidi et al.
10,076,173 B1 * 9/2018 Kaidi ..... A45D 29/02

* cited by examiner

*Primary Examiner* — Hwei-Siu C Payer
(74) *Attorney, Agent, or Firm* — George L Williamson

(57) ABSTRACT

Method and apparatus for a handheld nail clipper having generally the shape of a pistol for being easily and comfortably held in the hand of a user. The nail clipper has a plurality of user selectable replaceable blades so that the nails of the user can be cut into a plurality of shapes. The enclosure is designed to provide for a plurality of replacement blades so that the fingernail of the user can be held in a nail holder having a slot therein for receiving the tip of the fingernail so that the fingernail can be cut by the nail cutter blade as the cutter blade is activated by a moveable hand grip which is operated by the user.

18 Claims, 4 Drawing Sheets

FINGERNAIL CLIPPER

BACKGROUND OF THE INVENTION

Field of the Invention

The present invention relates generally to fingernail clippers and more particularly, is concerned with a fingernail clipper with an interchangeable cutting blade providing a plurality of user selectable shapes.

Description of the Related Art

Devices relevant to the present invention have been described in the related art; however, none of the related art devices disclose the unique features of the present invention.

In U.S. Pat. No. 5,727,318 dated Mar. 17, 1998, Reiswig disclosed clippers for fingernails. In U.S. Pat. No. 7,003,882 dated Feb. 28, 2006, Sakai disclosed a nail clipper. In U.S. Pat. No. 4,819,673 dated Apr. 11, 1989, McMullen, Jr., disclosed a nail clipper. In U.S. Pat. No. 4,637,137 dated Jan. 20, 1987, Husain disclosed a nail clipper. In U.S. Pat. No. 8,683,700 dated Apr. 1, 2014, Keidi et al. disclosed a nail clipper with blade insert. In U.S. Pat. No. 2,620,560 dated Dec. 9, 1952, Bahr disclosed a guard for a nail clipper. In U.S. Pat. No. 3,812,868 dated May 28, 1974, Keating disclosed a guarded fingernail clipper. In U.S. Pat. No. 4,982,747 dated Jan. 8, 1991, Shah disclosed a nail clipper with nail positioning device.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a handheld nail clipper having generally the shape of a pistol for being easily and comfortably held in the hand of a user. The nail clipper has a plurality of user selectable replaceable blades so that the nails of the user can be cut into a plurality of shapes. The enclosure of the present invention is designed to provide for a plurality of replacement blades so that the fingernail of the user can be held in a nail holder having a slot therein for receiving the tip of the fingernail so that the fingernail can be cut by the nail cutter blade as the cutter blade is activated by a moveable hand grip which is operated by the user.

An object of the present invention is to provide a fingernail clipper for use by an individual for cutting their own fingernails. A further object of the present invention is to provide a fingernail clipper having a plurality of replaceable blades for cutting the fingernail into a plurality of shapes. A further object of the present invention is to provide a fingernail clipper which can be easily operated by a user. A further object of the present invention is to provide a fingernail clipper which can be relatively easily and inexpensively manufactured.

The foregoing and other objects and advantages will appear from the description to follow. In the description, reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
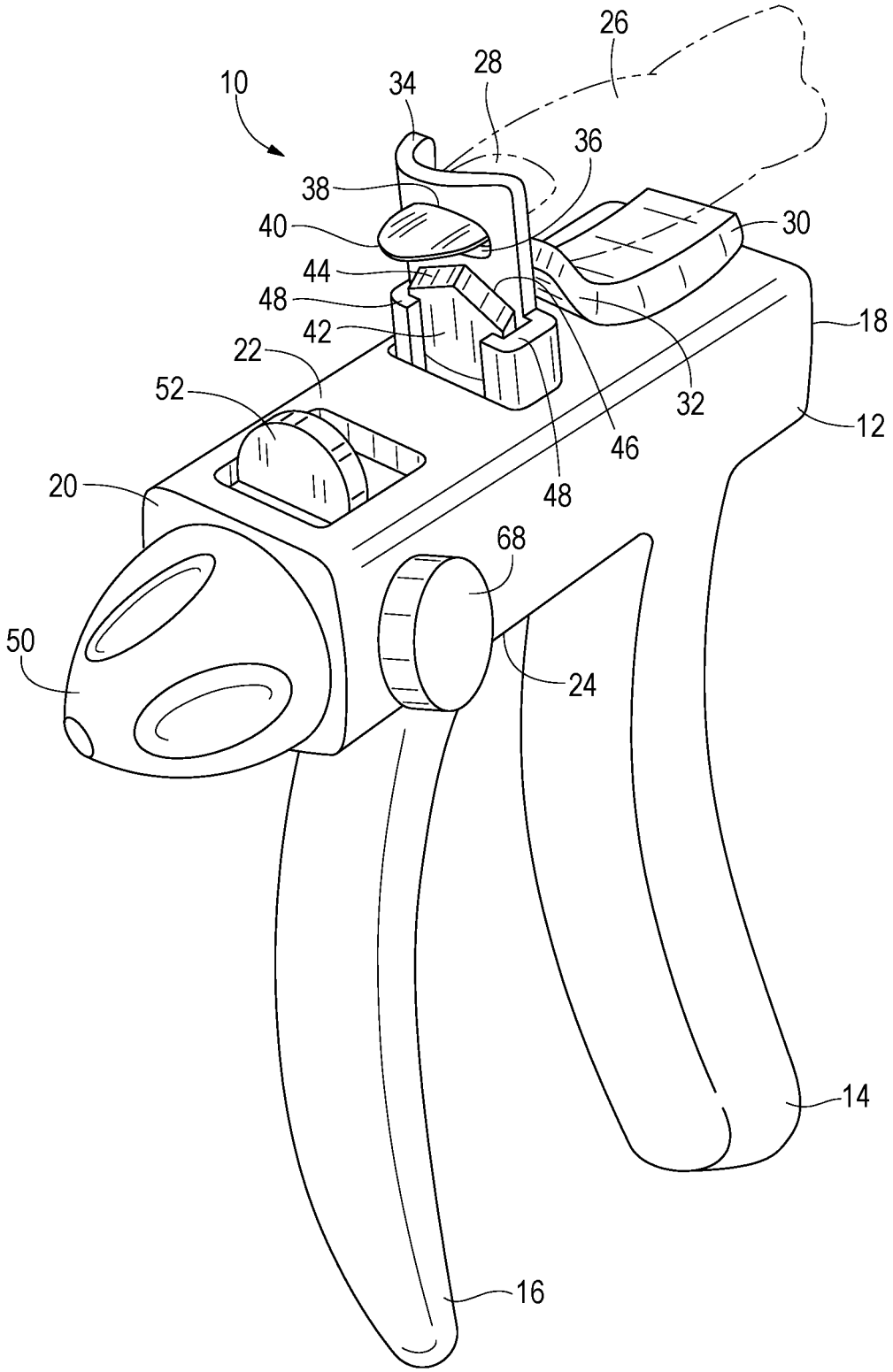
FIG. 1 is a perspective view of the present invention

With regard to reference numerals used, the following numbering is used throughout the drawings.

10 present invention
12 housing
14 stationary hand grip
16 movable hand grip
18 rear end
20 front end
22 upper surface
24 lower surface
26 finger
28 fingernail
30 finger rest
32 upwardly curved front
34 nail holder
36 slot
38 upper edge of slot
40 tip of fingernail
42 curved blade
44 tip of cutter
46 cutting edge
48 forwardly extending flange
50 knob
52 blade release tab
54 elongated screw shaft
56 threaded portion
58 ball nut portion
60 arm
62 pivot pin
64L left blade engagement arm
64R right blade engagement arm
66L left blade abutment
66R right blade abutment
68 cover
70L left leg
70R right leg

72L left contact
72R right contract
74 spring
76L left extension
76R right extension
78L left notch
78R right notch
79L left flange tip of leg
79R right flange tip of leg
80L sidewall of housing
82L longitudinal track
84L flange
84R flange
86L vertical track
88L flange
88R flange

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 8 illustrate the present invention wherein a fingernail clipper having replaceable blades is disclosed and which is generally indicated by reference number 10.

Turning to FIG. 1, therein is shown the present invention 10 having generally the shape of a pistol wherein it includes a housing 12 having a stationary hand grip 14 and a moveable hand grip 16 which can be operated by being held in the hand of a user. Also shown is a rear end 18 of the enclosure 12 along with a front end 20 and an upper surface 22 and a lower surface 24. Also shown on the upper part of the present invention 10 is a user's finger 26 with its associated fingernail 28 wherein the finger 26 is resting on a finger rest 30 having an upwardly curved front end 32 so that the fingernail 28 can pass through a nail holder 34 having a slot 36 therein through which the fingernail can pass. Also shown is an upper edge 38 of the slot for assisting in cutting the tip 40 of the fingernail. Also shown on the front 20 of the housing 12 is a rotatable adjustment knob 50 which is used to make adjustments to the finger rest 30 along with a blade release tab 52 which is used to release the curved blade 42 as will be hereinafter explained.

Figure 2:
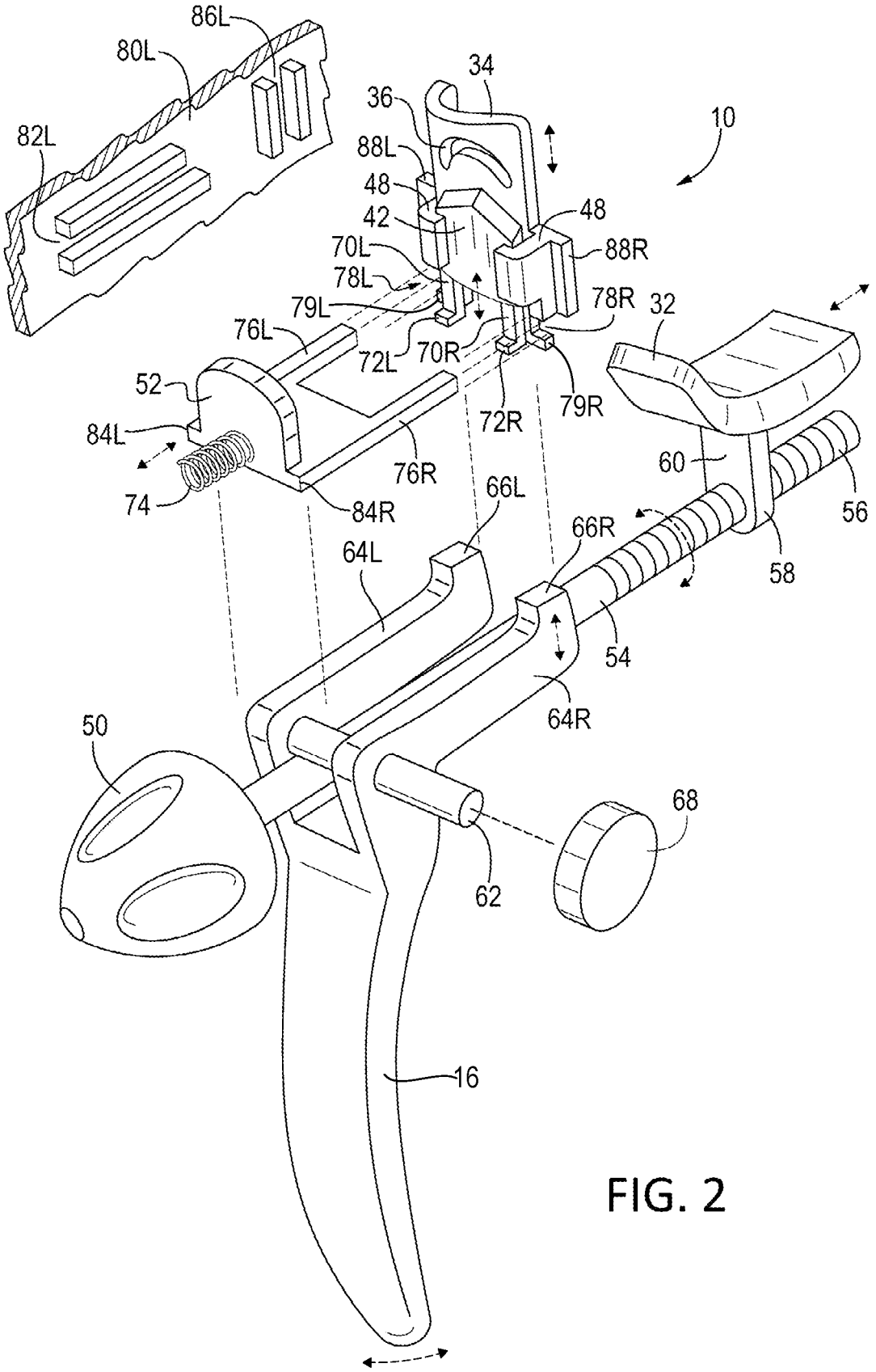
FIG. 2 is an exploded view of the present invention.

Turning to FIG. 2, therein is shown an exploded view of the present invention 10 wherein the rotatable adjustment knob 50 is shown on the front of an elongated screw shaft 54 having a threaded portion 56 on its rear part which cooperates with a ball nut portion 58 on a lower end of an arm 60 which extends downwardly from an underside of finger rest 30 which ball nut encircles the threaded portion 56 which responds to rotation of the adjustment knob 50 by moving the finger rest 26 frontwardly or backwardly in order to accommodate the different sizes of fingers and fingernails of a user. It can be seen that the movable hand grip 16 is pivotable about a pivot pin 62 to the front or rear wherein the movable hand grip also includes on its upper end left and right rearwardly extending blade engagement arms 64L, 64R having upwardly turned left and right blade abutments 66L, 66R on its rear end which abutments move the curved blade 42 upwardly when hand grip 16 is pulled rearwardly by engaging contacts 72L, 72R. The curved blade 42 is free to fall downwardly when hand grip 16 is released. Also shown is a cover 68 for placement over the end of the pivot pin 62 to provide an aesthetic appearance to the present invention 10.

FIG. 2 also shows the nail holder 34 and contained slot 36 along with forwardly extended flanges 48 at least partially encircling the curved cutting blade 42 for holding the curved blade 42 contiguously to the blade holder wherein the curved blade has downwardly extending left and right legs 70L, 70R and associated left and right contacts 72L, 72R on each leg which legs are spaced close enough together toward each other so as to be positioned inside the left and right extensions 76L, 76R. It can be seen that the blade release tab 52 has a spring 74 on its front end for biasing the blade release tab to the rear so that the left and right extensions 76L, 76R on the blade release tab 52 can move into the corresponding notches 78L, 78R thereby retaining the lower ends of the blade holder 34 which holds the curved blade 42. Thus, when the blade release tab 52 is in a rearward, closed position the extensions 76L, 76R are above flange tips 79L, 79R thereby retaining nail holder 34, and, then when the blade release tab 52 is in a forward, open position the extensions 76L, 76R are moved away from flange tips 79L, 79R thereby releasing nail holder 34 so that it can be removed from housing 12. One skilled in the art would understand that when the blade release tab 52 is moved toward the front 20 of the present invention 10 that the nail holder 34 could be lifted upwardly and away from the housing 12 so that the curved blade 42 could be removed and separated from the nail holder 34 which allows the curved blade 42 to be replaced by other curved blades of different shapes and sizes as illustrated in FIGS. 3 to 8. Also shown extending laterally away from the blade release tab 52 and nail holder 34 is a section of a sidewall 80L of housing 12 having a longitudinally disposed track 82L provided thereon in opposing sidewalls 80L of housing 12 for slidingly receiving flange 84L on the side of left extension 76L which allows the blade release tab 52 to slide back and forth internal the housing 12. Also shown is vertically disposed track 86L for slidingly receiving flange 88L on the side of nail holder 34 which moves upwardly and downwardly in track 86L. The opposing sidewall 80R (not shown) to sidewall 80L of housing 12 would have mirror images of the tracks 82L, 86L thereon so there would be tracks 82R, 86R (not shown) matching tracks 82L, 86L in each sidewall for slidingly receiving the oppositely disposed flanges 84R, 88R on the opposite sides of blade release tab 52 and nail holder 34. Note, wall section 80R, longitudinal track 82R, and vertical track 86R are not shown.

Figure 3:
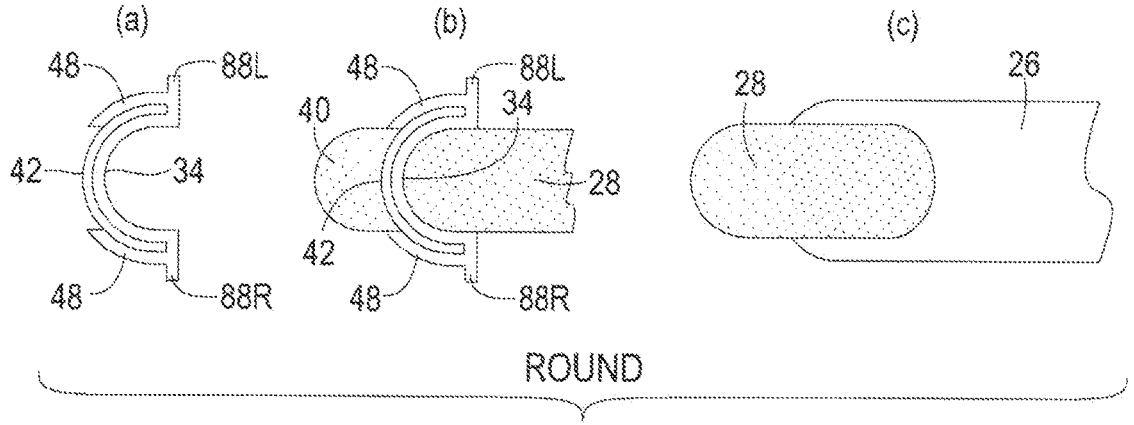
FIG. 3 is a plan view of portions of the present invention illustrating a fingernail being cut into a round shape.
Figure 4:
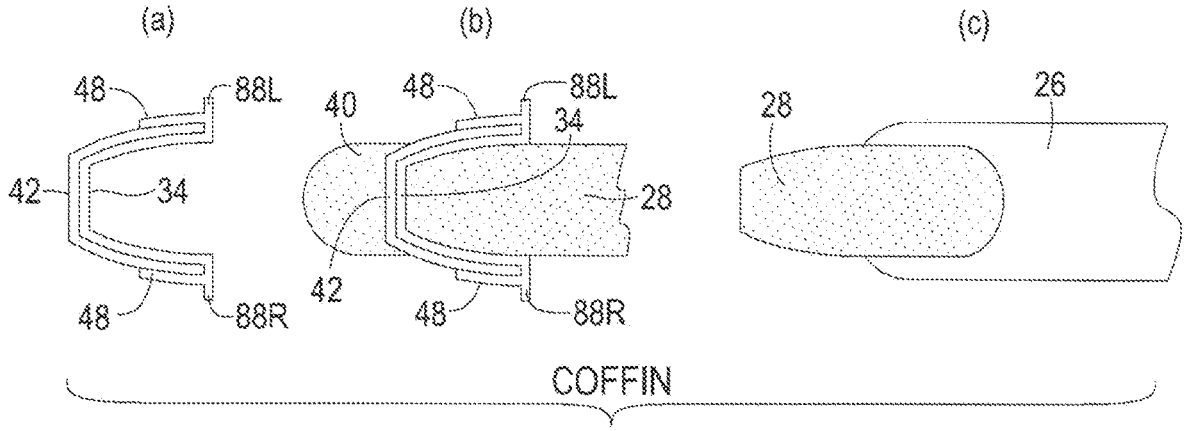
FIG. 4 is a plan view of portions of the present invention illustrating a fingernail being cut into a coffin shape.

Turning to FIG. 3, therein is shown a plan view wherein FIG. 3*a* shows the curved blade 42 along with nail holder 34, the flanges 88L, 88R, and the flanges 48; FIG. 3*b* shows fingernail 28 along with the curved blade 42 and the nail holder 34 along with the tip 40 of the fingernail 28 just as it is being cut through by the cutting blade 42 including the flanges 88L, 88R, and the flanges 48; and, FIG. 3*c* shows finger 26 and its associated fingernail 28 wherein the fingernail 28 and all of the associated components are shown having a round shape. The round shape is one of the six shapes disclosed in the present invention including the curved blades which are also made in the round shape.

Figure 5:
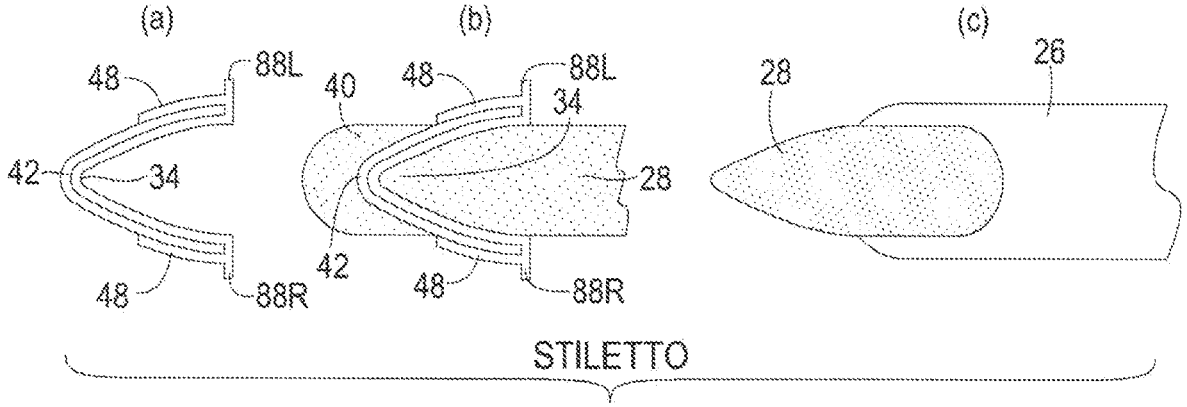
FIG. 5 is a plan view of portions of the present invention illustrating a fingernail being cut into a stiletto shape.
Figure 6:
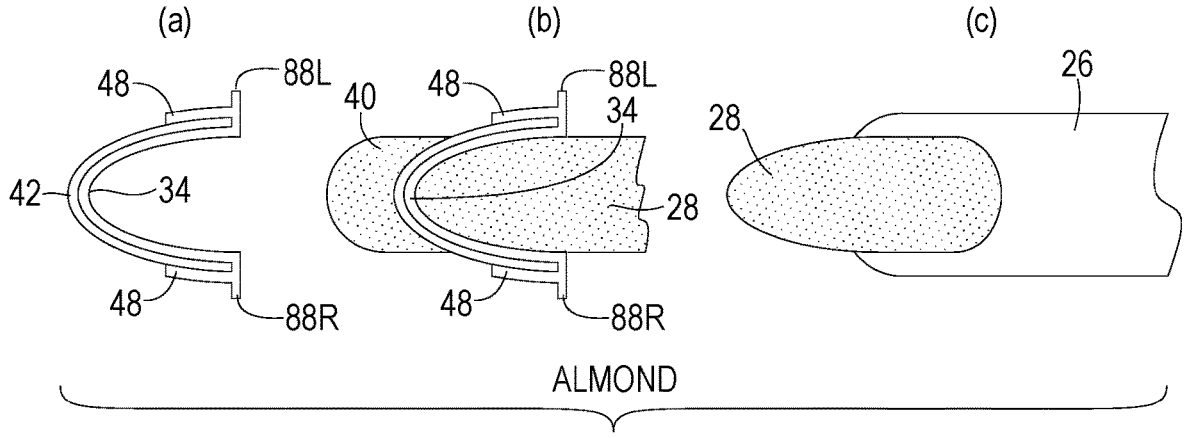
FIG. 6 is a plan view of portions of the present invention illustrating a fingernail being cut into an almond shape.
Figure 7:
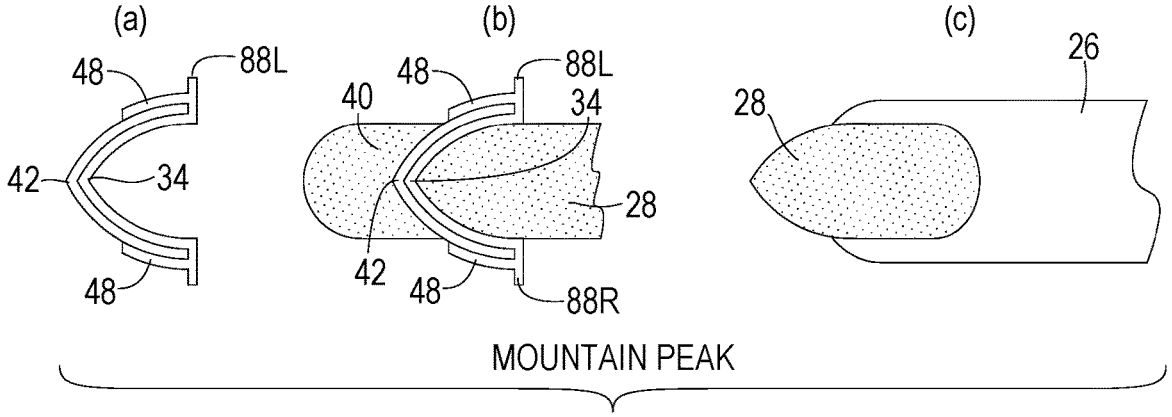
FIG. 7 is a plan view of portions of the present invention illustrating a fingernail being cut into a mountain peak shape.
Figure 8:
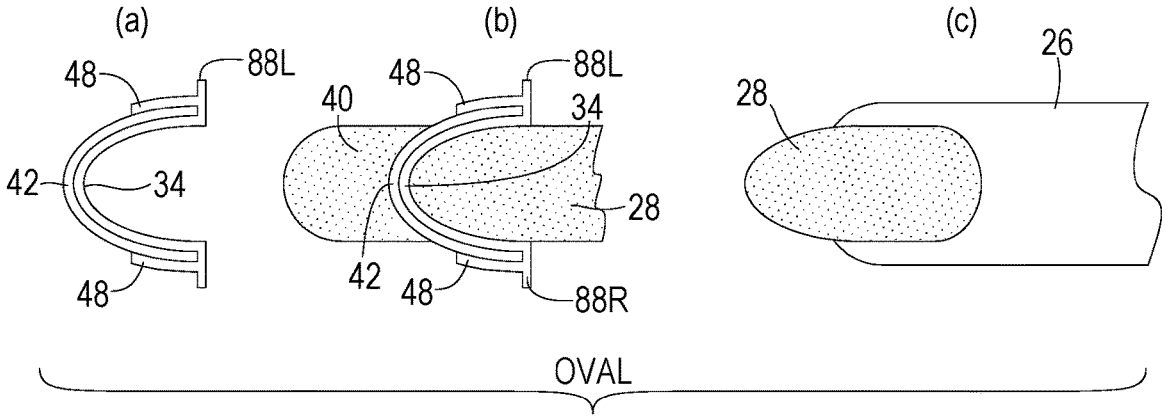
FIG. 8 is a plan view of portions of the present invention illustrating a fingernail being cut into a oval shape.

Turning to FIGS. 4 through 8, FIG. 4 shows fingernail 28 being cut into a coffin shape along with other previously disclosed elements; FIG. 5 shows fingernail 28 being cut into a stiletto shape along with other previously disclosed elements; FIG. 6 shows fingernail 28 being cut into an almond shape along with other previously disclosed elements; FIG. 7 shows fingernail 28 being cut into a mountain peak shape along with other previously disclosed elements; and FIG. 8 shows fingernail 28 being cut into an oval shape along with other previously disclosed elements.

Left and right side designations regarding the present invention 10 are interpreted from the view of one standing in front of the knob 50 and facing rearwardly, i.e., toward the rear end 18. Also, lines with arrowheads are sometimes placed on drawings to indicate potential motion or direction of movement of an item illustrated in the drawing.

By way of summary and by making reference to FIGS. 1-8, the present invention 10 discloses a method for assembling a fingernail clipper having replaceable cutting blades 42 for trimming a fingernail in a plurality of shapes, comprising the steps of providing a pistol shaped housing 12 having a stationary hand grip 14 extending downwardly from a rear end of said housing and a movable hand grip 16 disposed in front of the stationary hand grip and extending downwardly from the housing; providing a nail holder 34 having a slot 36 therein, the slot for receiving the fingernail 28 to be trimmed; providing a finger rest 30 upon which the finger 26 having the fingernail to be trimmed is rested, the finger rest being disposed behind the nail holder; providing a cutting blade mounted in front of and contiguously to the nail holder, the cutting blade being movable vertically across the slot to permit the fingernail to be trimmed; wherein the cutting blade moves in response to movement of the movable hand grip; and, wherein the cutting blade is replaceable with cutting blades having a plurality of user selectable shapes for cutting the fingernail into a plurality of shapes. Also, wherein the cutting blade shapes are user selected from the group consisting of round (FIG. 3), coffin (FIG. 4), stiletto (FIG. 5), almond (FIG. 6), mountain peak (FIG. 7), and oval (FIG. 8). Further comprising the step of providing a rotatable elongated screw shaft 54 joined to the finger rest wherein the finger rest moves forwardly or backwardly as the elongated screw shaft is rotated clockwise or counterclockwise, and providing a knob 50 disposed on a front of the housing for being grasped by a user for rotating the elongated screw shaft. Further comprising the step of providing a pivot pin 62 disposed proximate the front of the housing to permit the movable hand grip to pivot about the pivot pin and providing a cutting blade engagement arm 64 extending rearwardly from an upper end of the movable hand grip, a cutting blade abutment 66 disposed on a rear end of the cutting blade engagement arm for engaging a contact 72 disposed on a lower end of a leg 70 of the cutting blade to permit the cutting blade to be moved when the movable hand grip is moved. Further comprising the step of providing a blade release tab 52 disposed on an upper surface of the housing, an extension 76 extending rearwardly from the blade release tab from contacting a notch 78 disposed on a lower end of the nail holder to permit the nail holder to be retained when the blade release tab is in a closed position and the nail holder to be released when the blade release tab is in an open position and providing a spring 74 disposed on the blade release tab for biasing the blade release tab to the rear end of the housing and providing a forwardly extending flange 48 disposed on the nail holder for movable securing the cutting blade to the nail holder.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e. methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description may be intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively inclusive elements includes at least one element of the listed elements. However, an example described using a list of alternatively inclusive elements does not preclude another example that includes all of the listed elements. An example described using a list of alternatively inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

I claim:

1. A fingernail clipper useable with replaceable cutting blades for trimming a fingernail of a finger in a plurality of shapes, comprising:

(a) a pistol shaped housing having a stationary hand grip extending downwardly from a rear end of said housing and a movable hand grip disposed in front of said stationary hand grip and extending downwardly from said housing;

(b) a nail holder having a slot therein, said slot for receiving the fingernail to be trimmed;

(c) a finger rest upon which the finger having the fingernail to be trimmed is rested, said finger rest being disposed behind said nail holder;

(d) a cutting blade mounted in front of and contiguously to said nail holder, said cutting blade being movable vertically across said slot to permit the fingernail to be trimmed;

(e) wherein said cutting blade moves in response to movement of said movable hand grip;

(f) wherein said cutting blade is replaceable with cutting blades having a plurality of user selectable shapes for cutting the fingernail into a B plurality of shapes; and (g) a rotatable elongated screw shaft joined to said finger rest wherein said finger rest moves forwardly or backwardly as said elongated screw shaft is rotated clockwise or counterclockwise.

2. The clipper of claim 1, wherein said cutting blade shapes are user selected from the group consisting of round, coffin, stiletto, almond, mountain peak, and oval.

3. The clipper of claim 1, further comprising a pivot pin disposed proximate said front of said housing to permit said movable hand grip to pivot about said pivot pin.

4. The clipper of claim 3, further comprising a cutting blade engagement arm extending rearwardly from an upper end of said movable hand grip, a cutting blade abutment disposed on a rear end of said cutting blade engagement arm for engaging a contact disposed on a lower end of a leg of said cutting blade to permit said cutting blade to be moved relative to said nail holder when said movable hand grip is moved.

5. The clipper of claim 4, further comprising a blade release tab disposed on an upper surface of said housing, an extension extending rearwardly from said blade release tab for contacting a notch disposed on a lower end of said nail holder to permit said nail holder to be retained when said blade release tab is in a closed position and said nail holder to be released when said blade release tab is in an open position.

6. The clipper of claim 5, further comprising a spring disposed on said blade release tab for biasing said blade release tab to said rear end of said housing.

7. The clipper of claim 6, further comprising a forwardly extending flange disposed on said nail holder for movable securing said cutting blade to said nail holder.

8. The clipper of claim 7, further comprising a laterally extending flange on said nail holder for slidably cooperating with a vertical track disposed on a sidewall of said housing.

9. The clipper of claim 7, further comprising a laterally extending flange on said extension of said blade release tab for slidably cooperating with a longitudinal track disposed on a sidewall of said housing.

10. The clipper of claim 1, further comprising a knob disposed on a front of said housing for being grasped by a user for rotating said elongated screw shaft.

11. A method for assembling a fingernail clipper useable with replaceable cutting blades for trimming a fingernail of a finger in a plurality of shapes, comprising the steps of:

(a) forming a pistol shaped housing having a stationary hand grip extending downwardly from a rear end of said housing and mounting a movable hand grip in front of the stationary hand grip extending downwardly from the housing;

(b) mounting a nail holder having a slot therein on an upper part of the pistol shaped housing, the slot for receiving the fingernail to be trimmed;

(c) mounting a finger rest upon which the finger having the fingernail to be trimmed is rested on an upper part of the pistol shaped housing, the finger rest being disposed behind the nail holder;

(d) mounting a cutting blade in front of and contiguously to the nail holder, the cutting blade being movable vertically across the slot to permit the fingernail to be trimmed;

(e) wherein the cutting blade moves in response to movement of the movable hand grip;

(f) wherein the cutting blade is replaceable with cutting blades having a plurality of user selectable shapes for cutting the fingernail into a plurality of shapes and (g) joining a rotatable elongated screw shaft to the finger rest wherein the finger rest moves forwardly or backwardly as the elongated screw shaft is rotated clockwise or counterclockwise.

12. The method of claim 11, wherein the cutting blade shapes are user selected from the group consisting of round, coffin, stiletto, almond, mountain peak, and oval.

13. The method of claim 11, further comprising the step of forming a knob on a front of the housing for being grasped by a user for rotating the elongated screw shaft.

14. The method of claim 13, further comprising the step of mounting a pivot pin proximate the front of the housing to permit the movable hand grip to pivot about the pivot pin.

15. The method of claim 14, further comprising the step of extending a cutting blade engagement arm rearwardly from an upper end of the movable hand grip, a cutting blade abutment disposed on a rear end of the cutting blade engagement arm for engaging a contact disposed on a lower end of a leg of the cutting blade to permit the cutting blade to be moved when the movable hand grip is moved.

16. The method of claim 15, further comprising the step of mounting a blade release tab on an upper surface of the housing, an extension extending rearwardly from the blade release tab from contacting a notch disposed on a lower end of the nail holder to permit the nail holder to be retained when the blade release tab is in a closed position and the nail holder to be released when the blade release tab is in an open position.

17. The method of claim 16, further comprising the step of mounting a spring on the blade release tab for biasing the blade release tab to the rear end of the housing.

18. The method of claim 17, further comprising the step of forming a forwardly extending flange on the nail holder for movable securing the cutting blade to the nail holder.

* * * * *